United States Patent [19]

Mattle

[11] Patent Number: 4,988,332

[45] Date of Patent: Jan. 29, 1991

[54] METHOD FOR PRODUCING PACKING BAGS WHICH CAN BE STACKED ON A WICKET

[75] Inventor: Helmut Mattle, Gronau, Fed. Rep. of Germany

[73] Assignee: M u. W Verpackungen Mildenberger u. Willing GmbH & Co. KG, Gronau, Fed. Rep. of Germany

[21] Appl. No.: 347,525

[22] Filed: May 4, 1989

[30] Foreign Application Priority Data

Oct. 11, 1988 [DE] Fed. Rep. of Germany ..... 3834568

[51] Int. Cl.[5] ..... B31B 1/16; B31B 1/86

[52] U.S. Cl. ..... 493/196; 493/201; 493/235; 493/239; 493/342; 493/357

[58] Field of Search ..... 493/192, 194, 195, 196, 493/199, 200, 201, 206–209, 232, 231, 233, 235, 238, 239, 341, 342, 356, 357, 362, 924

[56] References Cited

U.S. PATENT DOCUMENTS 4,696,050 9/1987 Sengewald ..... 493/200

*Primary Examiner*—Frederick R. Schmidt
*Assistant Examiner*—Jack Lavinder
*Attorney, Agent, or Firm*—Felfe & Lynch

[57] ABSTRACT

A method for the production of packing bags which can be stacked on a wicket and unfolded while being filled, and for that purpose are provided at the bottom end of the bag with exposed wicket perforations disposed in a wicket tab. The bag is made from an outspread web which first is assembled to an open-sided tube and then into a flat-folded tube and bonded. The outspread web is severed in the area of the bag-length boundaries which set the bag lengths apart from one another, by means of a cut made transversely of the web, which produces a castellated outline. The bottom area and top area of two bag lengths lie adjacent one another and yield interfitting tabs and notches. The tabs in the top area can be laid one on the other to form a handle section and at least one tab in the bottom area is used as a wicket tab. Unneeded web material between the tabs is cut away.

7 Claims, 3 Drawing Sheets

METHOD FOR PRODUCING PACKING BAGS WHICH CAN BE STACKED ON A WICKET

BACKGROUND OF THE INVENTION

The invention relates to a method for the production of packing bags which can be stacked on a wicket and can be unfolded while they are being filled, and for that purpose are provided on their bottom end with exposed wicket perforations. The bags are made from a web which first is folded over to form a channel-like half tube and is then folded together and bonded to make a folded tube. Such a method is disclosed in U.S. Pat. No. 4,669,251.

The procedure disclosed in the aforementioned patent is as follows:

(a) Before a web is folded over to form a channel-like half-tue, wicket perforations and notches are cut at regular intervals and at the same level, the position of a notch in relation to the adjacent wicket perforations situated at the same level being selected such that, in the film tube, the notch is situated above the wicket perforations and exposes them.

(b) The web is folded over, with the creation of gusset folds if desired, to make an open-sided tube.

(c) A longitudinal seam is made at the meeting edges of the open-sides tube and thus a folded tube is created.

(d) The folded tube is cut to lengths at regular intervals.

(e) Cross-seams are welded (sealed) to form open-ended packing bags.

This known method has the disadvantage that relatively large waste cutouts are made in the area of the wicket perforations and that the provision of a handle requires additional steps which raise the cost of the product.

SUMMARY OF THE INVENTION

The principal object of the present invention is to improve the method described above so as to reduce the amount of unneeded film stock and in a simple manner to enable a handle on the packing bag to be included within the steps of the method.

This object, as well as other objects which will become apparent from the discussion that follows, are achieved, in accordance with a first version of the method of the invention, in that the laid-out web is severed in the area of the boundaries between bags at which the bag lengths are set apart from one another, by means of a cut made across the web creating a castellated shape, the bottom area and top area of two bag lengths being adjacent one another and interfitting tabs and notches being created, the tabs in the top area being able to be laid one on the other when the tube is folded, and at least one tab being used in the bottom area as a wicket tab, while additional tabs in the bottom area, which are not needed, are cut away.

The tabs, mentioned above, which are used as wicket tabs can be provided with wicket perforations even before they are cut apart and punched, for example while the web is being imprinted or embossed. It is also possible, however, to provide the wicket tabs with the perforations later on.

In a second version of the method it is not the outspread web that is cut, but first an open-sided tube or film tube is formed, which is then cut apart with a "puzzle cut," thus forming wicket tabs and handles. This method is characterized by severing the half-tube or film tube at the boundaries at which the bag lengths are set apart from one another, with a cut running transversely of the tube creating a castellated outline, while the bottom area and top area of two bag lengths lie adjacent one another and interfitting tabs and notches are formed, the super-imposed tabs resulting in a handle in the top area and at least one tab in the bottom area serving as a wicket tab.

In this second version of the method, prior to the folding, wicket perforations and/or cutouts are made at the same level in the desired spacing, the cutout assuming the same position as a bottom tab part which in the later-formed and cut folded tube will expose the area above a wicket perforation in a wicket tab at the bottom end of the bag.

Furthermore, a handle hole is advantageously punched in the superimposed handle tabs which will yield the handle portion.

Also, the superimposed handle tabs can be joined together by a transverse welded seam or a welded seam running along the cut edge.

It is also possible to arrange the wicket tabs horizontally in the area of a bag fold, double them over on one another, and later to perforate them.

Lastly, the method can be further expanded advantageously to provide scoring running transversely of the web or bag, so that the bags can be pulled apart with little effort.

Furthermore, along the boundary between bags, slightly back toward the upper edge of the bag, a welded seam can be provided which closes the bag in the handle area.

The two versions of the method according to the invention will now be explained in detail with the aid of the accompanying drawings.

DESCRIPTION OF THE PREFERRED EMBODIMENTS

To make a packing bag 1 like the one represented in FIG. 3, a paper or plastic film web 2 (hereinafter to be called simply "the web") is used. The web 2 is, for example, a single thickness of polyethylene film, a plastic-and-paper web, a laminated plastic web, or the like. In principle, any continuous web materials which are used in the packing industry and in bag manufacture can be used. German Utility Model Patent (Gebrauchsmuster) No. 85 30 670, by way of example, lists a series of known materials which may be used.

The web 2 is provided with a repeated imprint at the regular intervals R, in the present case appearing as "DRUCK I" and "DRUCK II" for the front and back of the bag, respectively. The boundary areas between bags are identified as 3 and 4. The same imprint is repeated at identical intervals according to the bag length.

Figure 2:
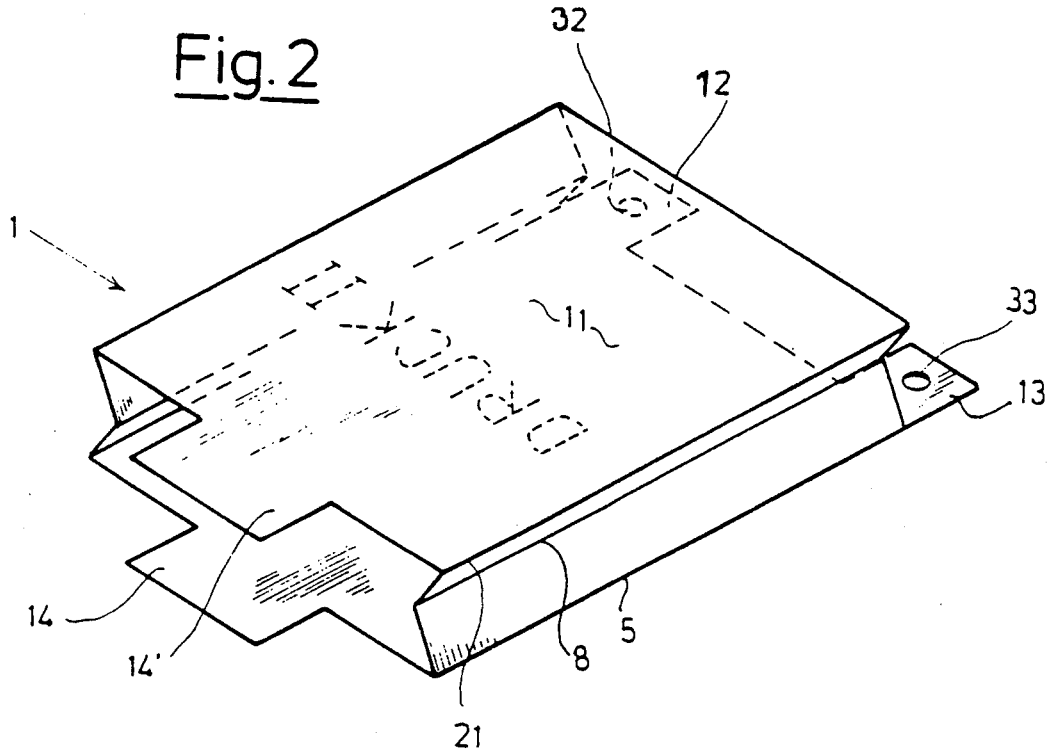
FIG. 2 shows an intermediate product obtained by making the cut shown in FIG. 1 and then folding.

At the boundaries 3 or 4 a bag bottom and a bag top will afterward abut against one another. In the present case the imprint appears upside down in phantom, assuming that the lines 5 to 9 represent fold lines, the solid lines 5, 6 and 7 being lines at which the two parts are folded rightward and leftward to produce a bag on which the imprint will then be on the outside. The broken lines 8 and 9 are crease lines for folding the gussets inwardly toward one another between the lines 5, 6 and 7. Between the crease areas, which generally will be the sides of the completed packing bag, are larger areas which correspond to the front and back 10 and 11, respectively. In FIG. 2, the crease lines are also given the same reference numbers for clarity.

Figure 1:
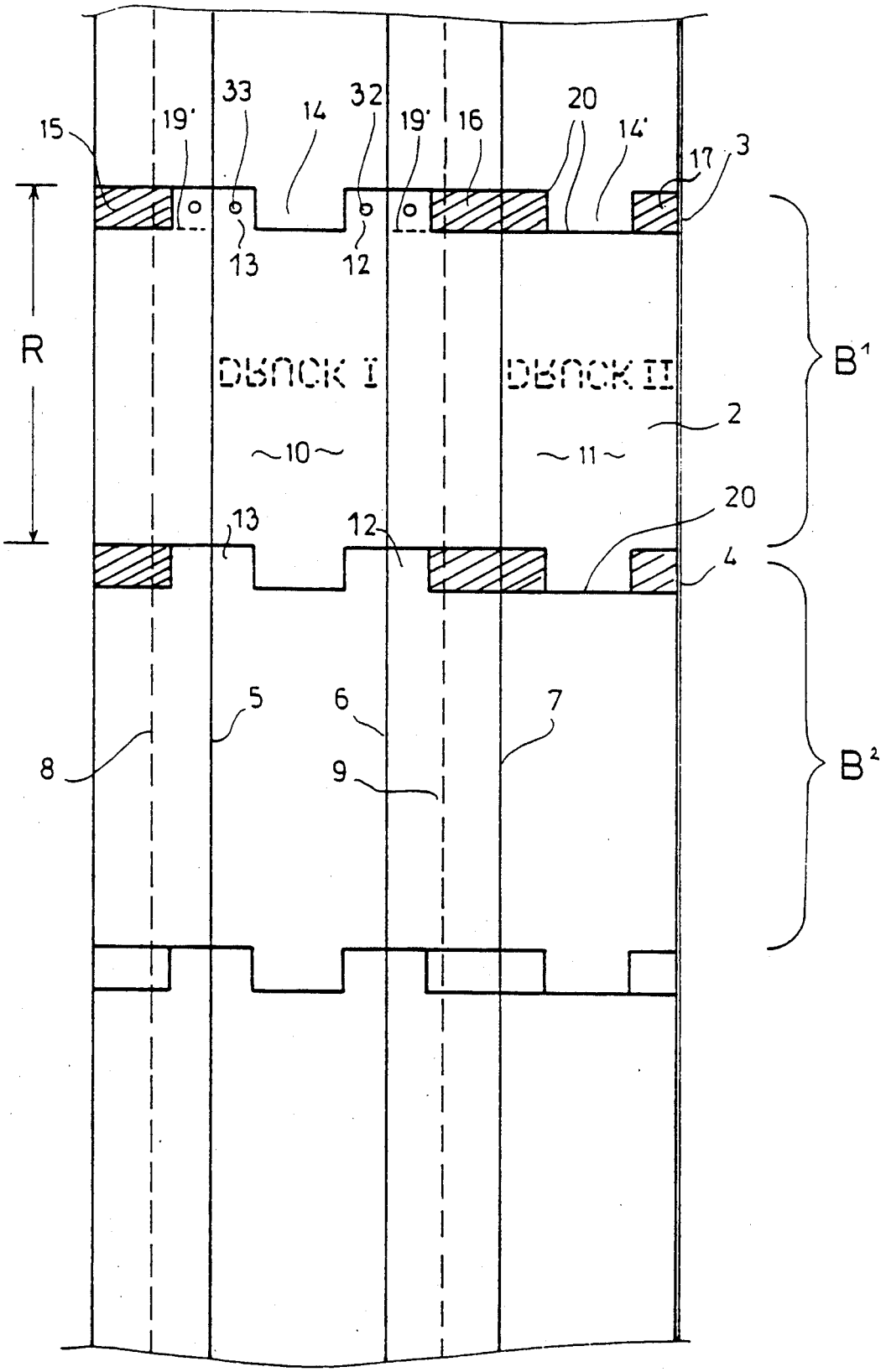
FIG. 1 is a top plan view of an outspread paper or plastic film web before the web is cut and folded in accordance with the first version of the method.

The outspread web 2 is severed with a cut running transversely of the web 2 in the boundary areas 3 and 4 which set the bag lengths $B^1$ and $B^2$ apart from one another. The cut 20 has a castellated outline, as shown in the figure, the outline being like a square-wave curve in the electronics field. This cut 20 results in tabs 12 and 13 in the area of the bottom of bag length $B^1$, which interfit with the similar other tabs 14 and 14' of the adjacent bag length. When the tabs 14 and 14' are removed, a corresponding notch will accordingly remain. The tabs 14 and 14' in the top area of the other bag length are later placed one on the other and form a handle tab, while the tabs 12 and 13 are doubled over at the creases 5 and 6 and thus form a double thickness. They are perforated simultaneously or afterward and then contain the wicket perforation 32. The hatched areas 15, 16 and 17 in FIG. 1 are removed in the same cut 20 and discarded. These removed areas 15 to 17, which are at the level of the tabs 12 and 13, prevent a portion of the film from being left upstanding when the bag is folded and covering the wicket perforations that are made afterward. Also, cuts 19 and 19' are provided so that half of each tab 12 and 13 can be doubled over.

The cuts 20 result in individual bag blanks $B^1$ and $B^2$ which are folded up so as to create side gussets. They result in open-sided tubes of which one is shown in FIG. 2, in which the open-sided tube is shown agape as an aid in comprehension. The outer edge is bonded by a longitudinal seam at 21, with the bag front 11 situated over the back 10. The handle portions, namely the tabs 14 and 14', lie one on the other, while tabs 12 and 13 project at the bottom, open end of the bag. After the seam 21 is made, a handle hole 23 is punched into the handle portions 14, 14', resulting in the handle 18. Furthermore, a closure seam 24 is also provided under the handle 18. The opposite, bottom end 25 of the bag 1 is open. The handles can also be joined together by an additional welded seam 24' at their upper edge.

Figure 3:
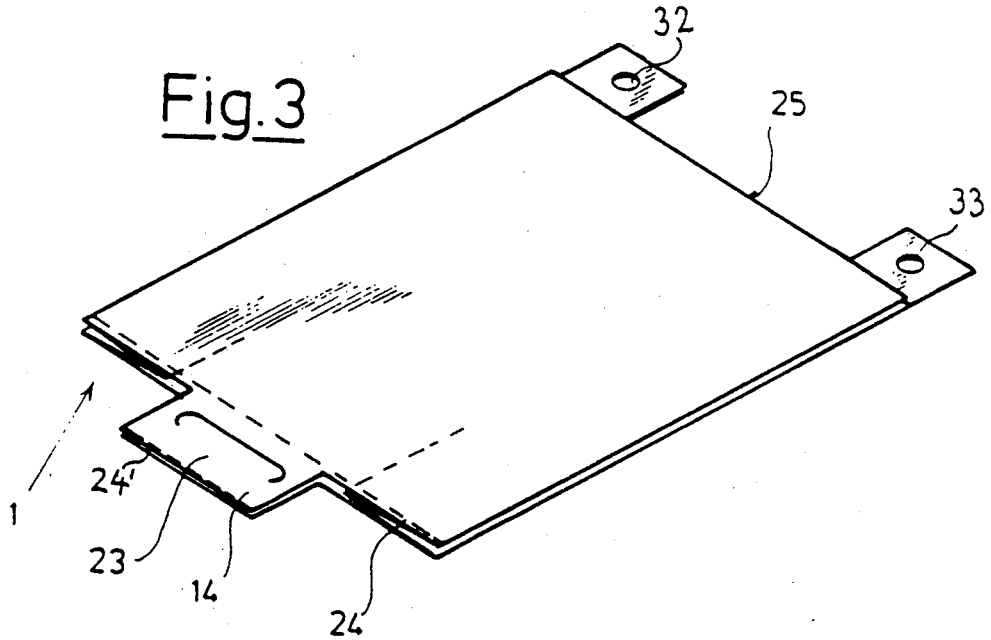
FIG. 3 shows the bag obtained from the intermediate product shown in FIG. 2.

The open-ended bag 1 in FIG. 3 can be spiked onto a two-prong wicket and stacked with many others of the same kind. The topmost bag can be inflated by means of an inflator, while the back of the bag is held by the wicket prong and the front of the bag floats free above the tip of the prong. By means of a gripping and filling apparatus the bag is filled, for example with baby diapers. It is to be noted that the wicket perforations 32 and 33 are completely exposed, so that no interference and no sticking of the front of the bag can occur. The wicket perforations 32 and 33 are preferably created in the first punching operation, or else when the severing cut 20 is made.

Figure 4:
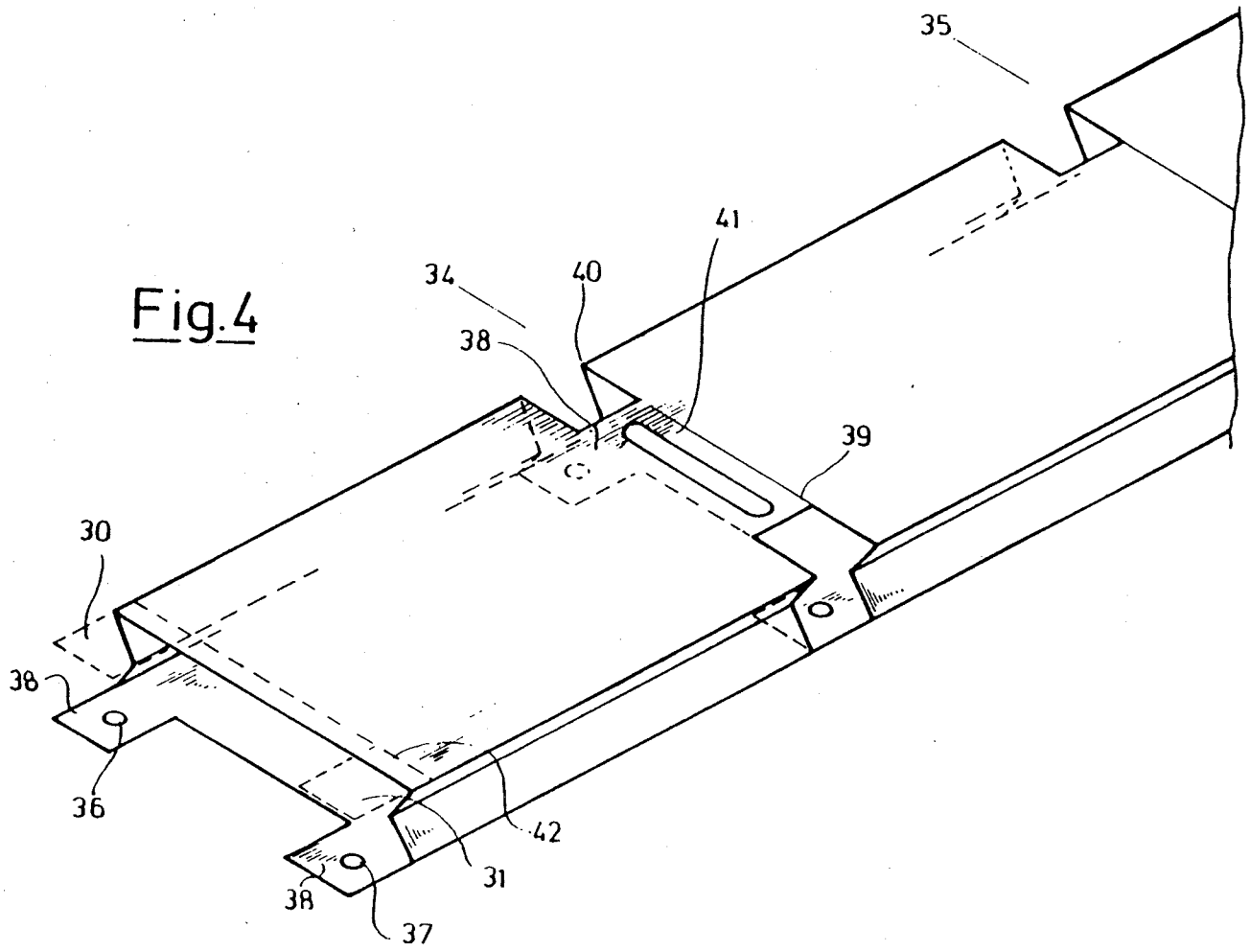
FIG. 4 shows a strand of tubing which is divided by cuts into single bags, in accordance with the second version of the method.

In a second version of the method, which is illustrated in FIG. 4, the above-described method is practiced by making several cutouts corresponding to portions 30 and 31 in the outspread paper or plastic film web before it is folded up and wicket perforations 36 and 37 are punched. The position of the cutouts 30 and 31 in relation to the adjacent wicket perforations 36 and 37 situated at the same level are so selected that, when the film tube is folded together, the cutouts 30 and 31 will be situated above the later wicket perforations exposing the latter. The web thus punched is folded up. Then an open-sided tube or film tube with seam is formed, in which, at the boundary areas 34 and 35 which set the bag lengths apart from one another, the bags are cut apart by means of a cut 40 made transversely of the tube and producing a castellated outline. At the bottom and top of two adjacent bag lengths, as seen in FIG. 4, this will result in interfitting tabs 41 and notches 39, while the superimposed tabs 41 in the top area result in a handle and at least one of the remaining tabs 38 in the bottom area on the back of the bag serves as a wicket tab provided with corresponding perforations 36 and 37. Especially in this configuration the amount of waste is relatively small. The bag is then closed in a known manner by a seam 42.

As already indicated, before the folding operation, the wicket perforations 36 and 37 and/or cutouts 30 and 31 are cut or punched into the web at the same level at the regular bag spacing, the cutout 30 or 31 corresponding to the location of a bottom tab, so that the folded tube that is later formed and cut will leave exposed the area above a wicket perforation (36, 37) on the back of the bag.

Also in the present case a handle hole can be punched into the superimposed handle tabs 41.

The cuts 40 can also be made in such a manner as to provide scoring to permit processing the structure formed of many bags as a continuous strand and tearing them apart shortly before they are stacked on the wicket prongs.

There has thus been shown and described a novel method for producing packing bags which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention which is limited only by the clams which follow.

What is claimed is:

1. A method for producing packing bags which are stackable on a wicket and unfoldable during a filling operation and for that purpose are provided with exposed wicket perforations disposed in a wicket tab, the bags being made from an outspread web having opposed outer edges, said web being first folded to an open-sided tube then made into a flat-folded tube, and bonded; said method comprising the steps of severing the outspread web at the regularly spaced intervals that separate the web into bag lengths having a bottom area and a top area means of cuts made transversely of the cuter edges of the web to form a castellated outline, the bottom area and top area of two successive bag lengths lying adjacent one another and resulting in interfitted tabs and notches, the tabs in the top area forming handle tabs; folding each bag length so that said handle tabs are superimposed; bonding the outer edges and the top area of each bag length to form an open ended tube; punching at least one tab in the bottom area with a hole to form a wicket tab; and removing unneeded additional web material between the tabs.

2. The method in accordance with claim 1, further comprising the steps of punching out the wicket perforations and cutouts while printing or embossing the web.

3. The method in accordance with claim 1, further comprising the step of punching a handle hole into the superimposed handle tabs.

4. The method in accordance with claim 1, further comprising the step of joining the superimposed handle tabs together by a weld seam lying transversely or along the cut edge.

5. The method in accordance with claim 1, wherein the wicket tabs are situated in the area of a bag fold and are folded one on the other to form a double leaf and are later perforated.

6. The method in accordance with claim 1, wherein the cut made transversely of the web leaves narrow tear sections.

7. The method in accordance with claim 1, further comprising the step of providing a weld seam along the bag boundary, slightly offset toward the bag top.

* * * * *

UNITED STATES PATENT AND TRADEMARK OFFICE

CERTIFICATE OF CORRECTION

PATENT NO. : 4,988,332

DATED : January 29, 1991

INVENTOR(S) : Helmut Mattle

It is certified that error appears in the above-indentified patent and that said Letters Patent is hereby corrected as shown below:

Column 4, line 63, "cuter edges" should be --outer edges--.

Signed and Sealed this

Sixth Day of July, 1993

*Attest:*

Michael K. Kirk

MICHAEL K. KIRK

*Attesting Officer*

*Acting Commissioner of Patents and Trademarks*